US005264672A

United States Patent [19]

Ishii et al.

[11] Patent Number: 5,264,672

[45] Date of Patent: Nov. 23, 1993

[54] MINIATURE ELECTRICAL SWITCHING UNIT

[75] Inventors: Masaru Ishii; Susumu Nakagawa, both of Tokyo, Japan

[73] Assignee: Daiichi Denshi Kogyo Kabushiki Kaisha, Japan

[21] Appl. No.: 825,110

[22] Filed: Jan. 24, 1992

[30] Foreign Application Priority Data

Jan. 31, 1991 [JP] Japan ..... 3-008428[U]

[51] Int. Cl.[5] ..... H01H 1/06

[52] U.S. Cl. ..... 200/275; 200/284; 200/541

[58] Field of Search ..... 200/275, 520, 530, 536, 200/540, 541, 549, 239, 246, 247, 248, 345, 282, 283, 284, 252, 257, 537

[56] References Cited

U.S. PATENT DOCUMENTS

| | | | |
|---|---|---|---|
| 2,700,088 | 1/1955 | Snyder | 200/275 |
| 2,777,037 | 1/1957 | Norton | 200/530 |
| 2,847,529 | 8/1958 | Murr | 200/275 X |
| 3,226,496 | 12/1965 | Seaburg | 200/275 X |
| 3,227,822 | 1/1966 | Corey | 200/275 X |
| 3,860,776 | 1/1975 | Lockwood | 200/246 X |
| 4,119,822 | 10/1978 | Kobayohi et al. | 200/275 X |

FOREIGN PATENT DOCUMENTS

| | | |
|---|---|---|
| 2523138 | 1/1976 | Fed. Rep. of Germany . |
| 7919940 | 4/1982 | Fed. Rep. of Germany . |
| 2028223 | 12/1990 | Fed. Rep. of Germany . |
| 2108324 | 5/1983 | United Kingdom . |

*Primary Examiner*—Henry J. Recla
*Assistant Examiner*—Glenn T. Barrett
*Attorney, Agent, or Firm*—Silverman, Cass & Singer, Ltd.

[57] ABSTRACT

A miniature switching unit including two fixed contact pieces arranged one above the other and fixed to terminals, respectively, and a movable contact piece. Each of the fixed contact pieces is made of springy wire members and includes parallel portions having equal inner distances, respectively. The movable contact piece in the form of a rod having a thickness slightly larger than the inner distances of the parallel portions of the fixed contact pieces and includes an intermediate insulator, an upper conductor axially, concentrically and integrally connected to the upper end of the intermediate insulator and a forward conductor axially, concentrically and integrally connected to the lower end of the intermediate insulator. The movable contact piece is held in a housing so as to be positioned in and contacting the parallel portions of the first and second fixed contact pieces and movable in a manner that the intermediate insulator moves across any one of the first and second fixed contact pieces, which are arranged one above the other.

8 Claims, 6 Drawing Sheets

MINIATURE ELECTRICAL SWITCHING UNIT

BACKGROUND OF THE INVENTION

This invention relates to a miniature electrical switching unit, and more particularly to a miniature switching unit having a long service life whose contact piece does not yield due to prolonged use.

A switching unit is often used for switching over electric circuits. For example, as shown in FIG. 8, a switching unit 4 is used for switching over the internal and external antennas 1 and 2 of a transmitter-receiver 3 to switch over transmission and reception. FIG. 9 illustrates a switching unit hitherto used in such a case, which includes one terminal 6 having a spring contact piece 5 fixed to its end and the other terminal 8 having at its end a contact 7. These terminals 6 and 8 are fixed in the housing 9 so that one end of the spring contact piece 5 is always in contact with the contact 7 of the terminal 8 under a pressure to connect the internal antenna 1 and the transmitter-receiver 3.

On the other hand, the housing 9 is integrally formed with a cylindrical support portion 9*a* in which a connection unit 12 is provided. The connection unit 12 includes a movable contact element 11 integrally formed at its upper end with a flange 11*a*, and a return spring 10 having an upper end abutting against the flange 11*a* of the movable contact element 11 to urge the contact element 11 upwardly. When a mating connection unit 13 connected with the external antenna 2 and having a fixed contact element 14 is inserted into and connected to the connection unit 12, the movable contact element 11 is moved downwardly by the fixed contact element 14 of the mating connection unit 13 against the spring force of the spring contact piece 5. As a result, the spring contact piece 5 comes out of contact with the contact 7 of the terminal 8 as shown in broken lines in FIG. 9 so that the external antenna 2 is connected to the transmitter-receiver 3.

With recent miniaturization of communication appliances, switching units for use in wireless appliances, for example, portable wireless appliances have been strongly required to be more miniaturized. As a result, there have been very small switching units, for example, having one side length less than 15 mm. Consequently, the spring contact piece 5 has become very short, less than 10 mm, which is repeatedly deformed correspondingly by the vertical movements of the movable contact element 11. Accordingly, the spring contact piece 5 encounters the following problems in design and manufacture:

The shorter the spring contact piece 5, the greater is the moving distance of the contact piece 5 relative to its length by the movable contact element 11. Therefore, the design of the spring contact piece 5 becomes difficult due to its elastic limit. Even if the design is possible, produced spring contact pieces 5 are poor in uniformity and hence exhibit spring forces in a wide range resulting in different contact pressures with contacts 7 of terminals 8 with less reliability in connection. In addition thereto, the spring contact piece 5 is likely to be fatigued or to yield in a short period of time and thus shorten its service life. Moreover, when the spring contact piece 5 is returned to its original position after release from the movable contact element 11, the spring contact piece 5 contacts the contact 7 of the terminal 8 only with low pressure due to its yielding, which tends to cause insufficient connection with the contact 7.

Therefore, reliable connection as a switching unit cannot be accomplished.

SUMMARY OF THE INVENTION

It is an object of the invention to provide a miniature electrical switching unit which eliminates all the disadvantages of the prior art and which is advantageous for design and manufacture and reliable in operation and has a long service life.

In order to accomplish this object, in a miniature switching unit including fixed contact means and movable contact means according to the invention, the fixed contact means comprises a first fixed contact piece fixed to a first terminal and a second fixed contact piece fixed to a second terminal, the first and second fixed contact pieces being made of springy wire members and including parallel portions having equal inner distances, respectively, and the parallel portions being arranged one above the other, and the movable contact means comprises a movable contact piece in the form of a rod having a thickness slightly larger than the inner distances of the parallel portions of the first and second fixed contact pieces, and the movable contact piece including an intermediate insulator having an axial length shorter than the vertical distance between the parallel portions of the first and second fixed contact pieces, an upper conductor axially concentrically and integrally connected to the upper end of the intermediate insulator and a forward conductor axially concentrically and integrally connected to the lower end of the intermediate insulator and having an axial length longer than the vertical distance between the parallel portions of the first and second fixed contact pieces, and the movable contact piece being held in a housing so as to be positioned in and contacting the parallel portions of the first and second fixed contact pieces and movable in a manner that the intermediate insulator moves across any one of the first and second fixed contact pieces, which are arranged one above the other.

One terminal may be electrically connected to the forward conductor of the movable contact piece by means of a flexible electric wire having dip or slackening instead of connecting to the lower fixed contact piece.

The invention will be more fully understood by referring to the following detailed specification and claims taken in connection with the appended drawings.

DESCRIPTION OF THE PREFERRED EMBODIMENTS

Figure 1:
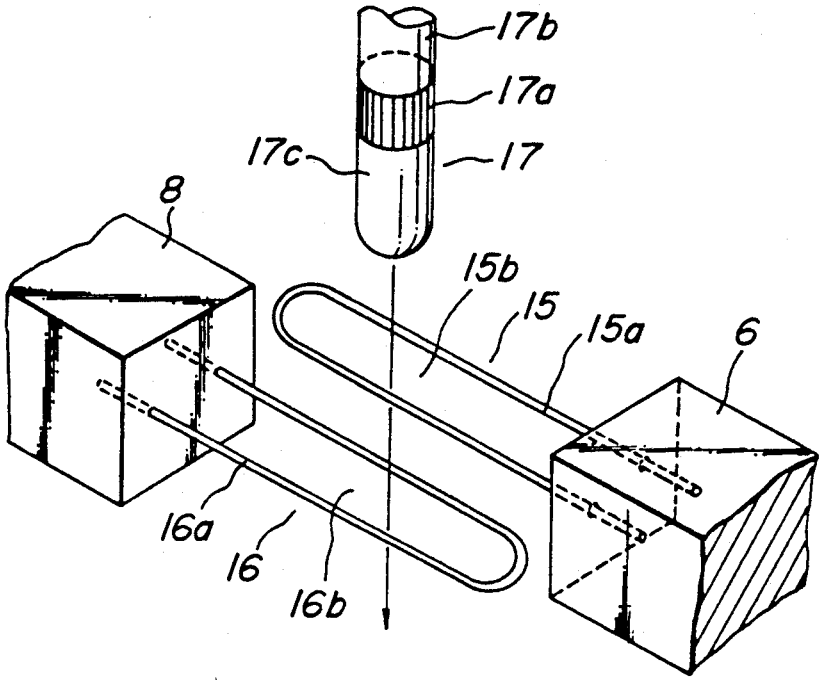
FIG. 1 is a perspective view for explaining the fundamental construction of the unit according to the invention.

Referring to FIG. 1, a switching unit according to the invention comprises a fixed connection portion including fixed contact pieces 15 and 16. The fixed contact piece 15 includes a U-shaped springy wire member 15*a* having one end (or both ends) connected and fixed to one terminal 6 fixed in a housing (not shown) to form a parallel portion 15*b*. In the same manner, the fixed contact piece 16 includes a U-shaped springy wire member 16*a* having one end connected and fixed to the other terminal 8 fixed in the housing (not shown) to form a parallel portion 16*b*. The parallel portions 15*b* and 16*b* are arranged one above the other with a predetermined distance. The widths between two wires of the parallel portions 15*b* and 16*b* are substantially equal to each other.

A movable contact piece 17 is in the form of a rod having a diameter slightly greater than the distance between the two wires of the parallel portions 15*b* and 16*b*. The movable contact piece 17 includes an intermediate insulator 17*a*, an upper conductor 17*b* and a forward conductor 17*c* as shown in FIG. 1. The intermediate insulator 17*a* has an axial length shorter than the distance between the fixed contact pieces 15 and 16. The upper and forward conductors 17*b* 17*c* are concentric to the intermediate insulator 17*a* and integrally joined with both the ends of the intermediate insulator 17*a*, respectively. The forward conductor 17*c* has an axial length longer than the distance between the fixed contact pieces 15 and 16.

Figure 2A:
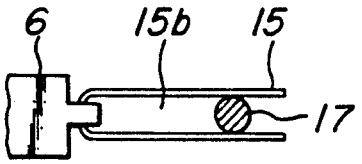
FIGS. 2*a*, 2*b* and 2*c* are plan views illustrating modifications of the fixed and movable contact pieces of the invention.
Figure 2B:
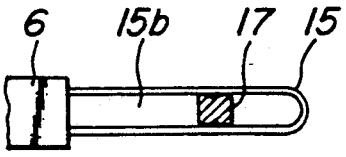
Figure 2C:
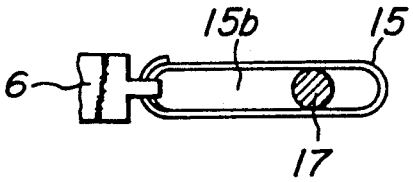
Figure 3A:
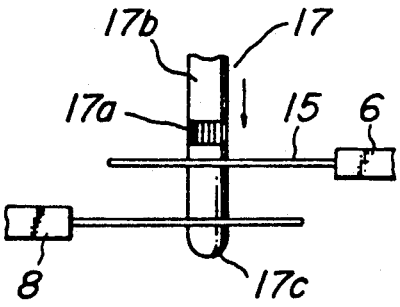
FIGS. 3*a* and 3*b* are explanatory views of switching operations of the unit according to the invention.
Figure 3B:
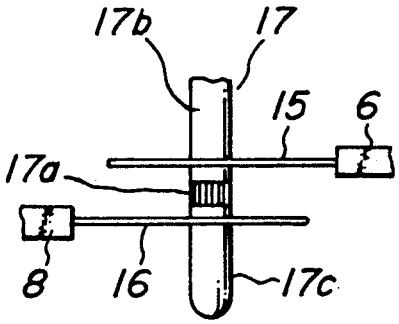

The movable contact piece 17 is arranged in the housing (not shown) so that outer circumferences of the movable contact piece 17 are in contact with the two wires of the parallel portions 15*b* and 16*b* of the fixed contact pieces 15 and 16 with substantially the same pressure as shown in FIGS. 2*a*, 2*b* and 2*c*, and the intermediate insulator 17*a* is movable between positions above and below the fixed contact piece 15 arranged on the upper side as shown in FIGS. 3*a* and 3*b*.

When the movable contact piece 17 has been moved upwardly so that the intermediate insulator 17*a* is positioned above the fixed contact piece 15, the forward conductor 17*c* of the movable contact piece 17 is embraced between the wires of the parallel portions 15*b* and 16*b* of the fixed contact pieces 15 and 16 to contact the fixed contact pieces 15 and 16 as shown in FIG. 3*a*. As a result, the terminals 6 and 8 are electrically connected with each other. Moreover, when the movable contact piece 17 has been moved downwardly so that the intermediate insulator 17*a* is positioned between the upper and lower fixed contact pieces 15 and 16, the upper conductor 17*b* is embraced between the wires of the parallel portion 15*b* of the upper fixed contact piece 15 so that the upper conductor 17*b* and the terminal 6 are electrically connected with each other.

In other words, the movable contact piece 17 slidably moves only between the wires of the parallel portions 15*b* and 16*b* of the fixed contact pieces 15 and 16 without causing the fixed contact pieces 15 and 16 to be deformed in the moving direction of the movable contact piece 17 so that deformations of the fixed contact pieces 15 and 16, if any, are not caused by the vertical movements of the movable contact piece 17. Therefore, even if the lengths of the fixed contact pieces 15 and 16 are extremely short, it is possible to produce a switching unit without encountering any difficulty in designing and manufacturing, which is stable in performance and durable in use.

Moreover, the movable contact piece 17 is slidably moved vertically, while it is embraced between the wires of the parallel portions 15*b* and 16*b* of the fixed contact pieces 15 and 16. Therefore, the movable contact piece 17 is restrained against wobbling or lateral movement so that instantaneous disconnection due to vibrations is prevented to improve the reliability of connection of the unit.

The fixed contact pieces 15 and 16 may be fixed to the terminals 6 and 8 in various manners as shown in FIGS. 2*a*, 2*b* and 2*c* and may be in the form of loops as shown in FIG. 2*c*. The loop shown in FIG. 2*c* is made of two semicircles and two parallel straight lines having equal lengths and connecting the ends of the two semicircles. Moreover, the fixed contact pieces 15 and 16 may be different in shape, for example, U-shaped and loop-shaped, so long as the distances between the wires of the parallel portions are kept constant to obtain desired contact pressure with the movable contact piece 17. While the fixed contact pieces 15 and 16 are arranged one above the other in parallel relationship in the above embodiment, they may be arranged one above the other in intersecting directions, if required.

The intermediate insulator 17*a* of the movable contact piece 17 is preferably made of fluoroplastics but may be formed of any one of other material superior in electrical insulation characteristics, wear-resistance and strength sufficient to resist the embracing force of the fixed contact pieces 15 and 16. While the fixed contact pieces 15 and 16 are preferably made of a wire having a circular cross-section, they may be of any one of other cross-sections, for example, square cross-section as shown in FIG. 2*b*, so long as they smoothly contact the movable contact piece 17.

Figure 4:
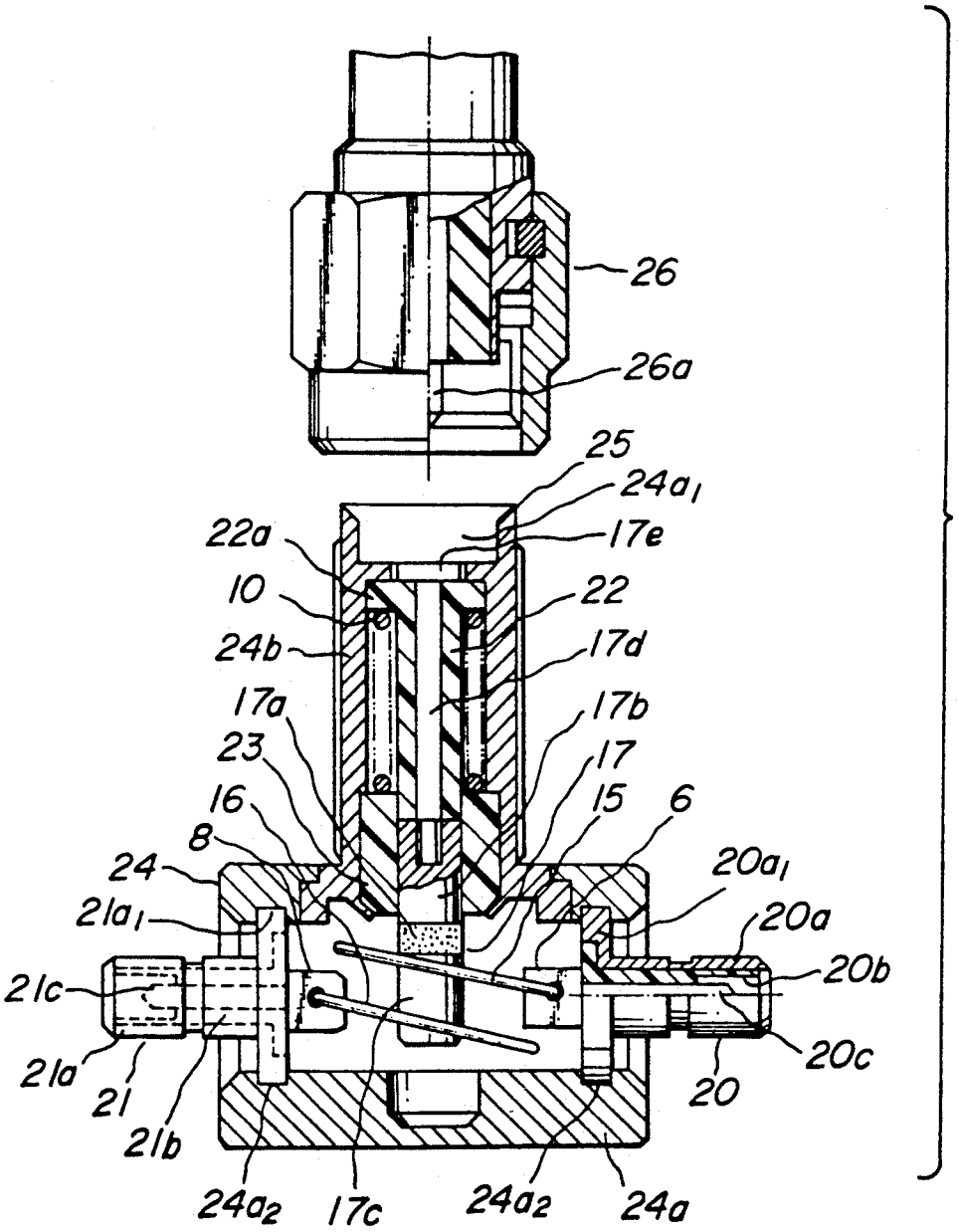
FIG. 4 is an explanatory view illustrating one embodiment of the unit according to the invention.

FIG. 4 illustrates another embodiment according to the invention applied to a miniature switching unit of a coaxial type. This miniature switching unit includes a movable contact piece 17 of 2.4 mm diameter having an intermediate insulator 17*a* of 0.8 mm length and a forward conductor 17*c* of 3 mm length, and fixed contact pieces 15 and 16 made of a spring wire of 0.3 mm diameter and 8 mm length and fixed to the housing and vertically 2 mm distance spaced from each other.

Referring to FIG. 4, a first coaxial connector receptacle 20 and a second coaxial connector receptacle 21 are substantially the same in configuration and fitted in the switching unit. Each of the connector receptacles includes an external contact 20*a* or 21*a* having a mounting flange $20a_1$ or $21a_1$, and a center contact 20*c* or 21*c* supported by an insulator 20*b* or 21*b* at the center of the connector receptacle. When the connector receptacles are connected to coaxial connector plugs (not shown), respectively, they are connected to, for example, an internal antenna and a transmitter-receiver, respectively.

Terminals 6 and 8 are coaxial to and integral with the center contacts 20, respectively, and form fixed contact pieces. Fixed contact pieces 15 and 16 are made of springy wires plated with gold in the form of loops as shown in FIG. 2*c*, and electrically and mechanically fixed to the terminals 6 and 8 by soldering at the overlapped portions of their ends so that they are kept parallel to each other and inclined relative to a movable contact piece.

The movable contact piece 17 includes an intermediate insulator 17*a*, an upper conductor 17*b* and a forward conductor 17*c*, and a conductor actuator 17*d* having a diameter less than that of the upper conductor 17*b*, and an urging flange 17*e* provided on the upper end of the conductor actuator 17*d*. The conductor actuator 17*d* is integrally connected to the upper conductor 17*b* by means of known means such as screw threads. On the other hand, the intermediate insulator 17*a*, the upper conductor 17*b* and the forward conductor 17*c* may be connected in manners as shown in FIGS. 5*a* and 5*b* because these members are small.

Figure 5A:
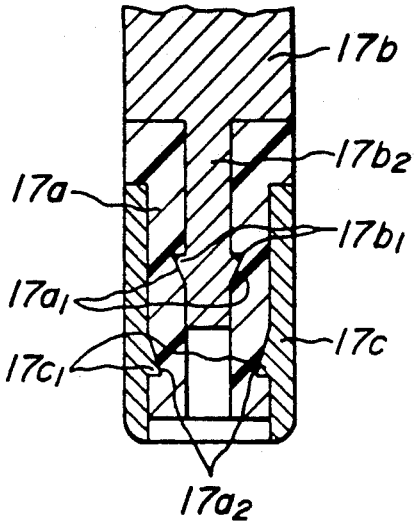
FIGS. 5*a* and 5*b* are sectional views illustrating modifications of the movable contact piece according to the invention.

In the example in FIG. 5*a*, an upper conductor 17*b* is formed at its lower end with a reduced diameter portion $17b_2$ having a circular protrusion $17b_1$ having a triangular section, on which a hollow cylindrical intermediate insulator 17*a* having circular recesses $17a_1$ and $17a_2$ having triangular sections on the inner and outer surfaces is press-fitted. The circular protrusion $17b_1$ and the circular recess $17a_1$ are fitted with each other. An adhesive may be additionally used. A hollow cylindrical forward conductor 17*c* having a circular protrusion $17c_1$ having a triangular section on the inner surface is then press-fitted on the intermediate insulator 17*a* so as to expose required part of the intermediate insulator 17*a* to form a complete movable contact piece. The circular protrusion $17c_1$ and the circular recess $17a_2$ are fitted with each other.

Figure 5B:
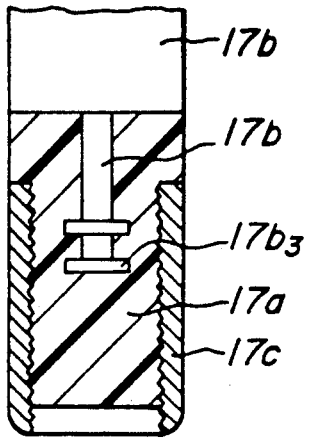

In the example in FIG. 5*b*, an upper conductor 17*b* is formed at its lower end with a reduced diameter portion $17b_3$ having flanges at the lower end, around which an intermediate insulator 17*a* is formed by molding. After the intermediate insulator 17*a* is formed on its outer surface with a screw thread, a forward conductor 17*c* are threadedly engaged on the intermediate insulator 17*a* to expose required part of the intermediate insulator 17*a*.

Referring back to FIG. 4, a cylindrical insulating cover member 22 having an upper flange 22*a* is moved together with the conductor actuator 17*d* enclosed therein. A cylindrical insulating guide 23 is fixed in the housing for guiding the movable contact piece 17. A return spring 10 is provided between the flange 22*a* of the insulating cover member 22 and the insulating guide 23 for urging the movable contact piece 17 to its original position.

The conductive housing 24 includes a main housing 24*a* having a cover for fixing the fixed contact pieces 15 and 16, and an auxiliary housing 24*b* serving to fix the insulating guide 23 therein and having at the upper end an opening $24a_1$ for urging the urging flange 17*e* of the movable contact piece 17. The auxiliary housing 24, the movable contact piece 17 and the like form a third connector receptacle 25. The movable contact piece 17 and the insulating cover member 22 fitted on the conductor actuator 17*d* of the contact piece 17 are inserted into the cylindrical insulating guide 23 fixed in the auxiliary housing 24*b*. Thereafter, the mounting flanges $20a_1$ and $21a_1$ of the coaxial connector receptacles 20 and 21 are press-fitted into press-fitting grooves $24a_2$ formed in the main housing 24*a* and the cover, while the movable contact piece 17 is being inserted between the wires of the parallel portions of the fixed contact pieces 15 and 16. The cover is then fixed to the main housing 24*a*, for example, by means of set screws.

With the switching unit constructed described above, by connecting coaxial connector plugs (not shown) to the coaxial connector receptacles 20 and 21, center conductors of coaxial cables connected to the center contacts of the connector plugs are connected to each other through the fixed contact pieces 15 and 16, and external conductors of the coaxial cables connected to the external contacts are also connected to each other through the conductive housing 24, with the result that the circuits connected to the coaxial connector receptacles 20 and 21 are connected to each other.

Under this condition, by connecting an coaxial connector plug 26 connected to an external antenna to the third coaxial connector receptacle 25, the center contact 26*a* of the coaxial connector plug 26 is electrically connected through the urging flange 17*e* to the movable contact piece 17. Moreover, the intermediate insulator 17*a* of the movable contact piece 17 is positioned between the fixed contact pieces 15 and 16 without contacting therewith so that the electrical connection between the fixed contact pieces 15 and 16 is disconnected. At this moment, however, the upper conductor 17*b* and the the upper fixed contact piece 15 are electrically connected to each other so that the center contact 26*a* of the coaxial cable connected to the coaxial connector plug 26 is electrically connected to the center contact 20*c* of the coaxial connector receptacle 20, and also the external contacts are electrically connected to each other through the conductive housing 24. The electrical switching-over of the switching unit is accomplished in this manner.

Figure 6:
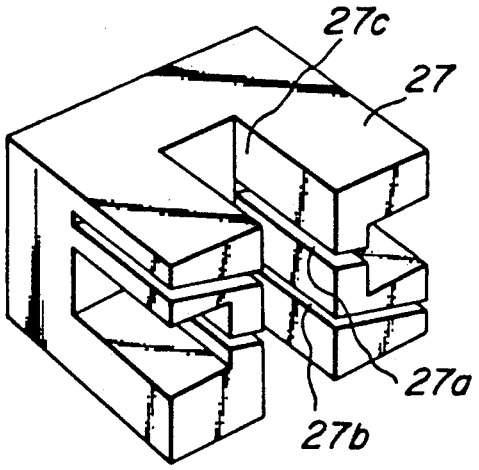
FIG. 6 is a perspective view illustrating a support member for the fixed and movable contact pieces according to the invention.
Figure 7:
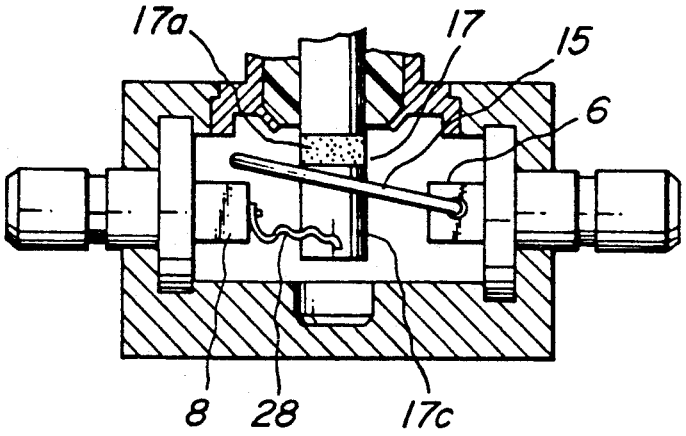
FIG. 7 is a partial sectional view illustrating a further embodiment of the invention.
Figure 8:
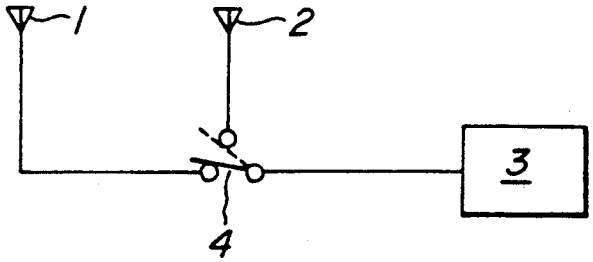
FIG. 8 PRIOR ART
FIG. 8 is a schematic view illustrating one application of a switching unit.
Figure 9:
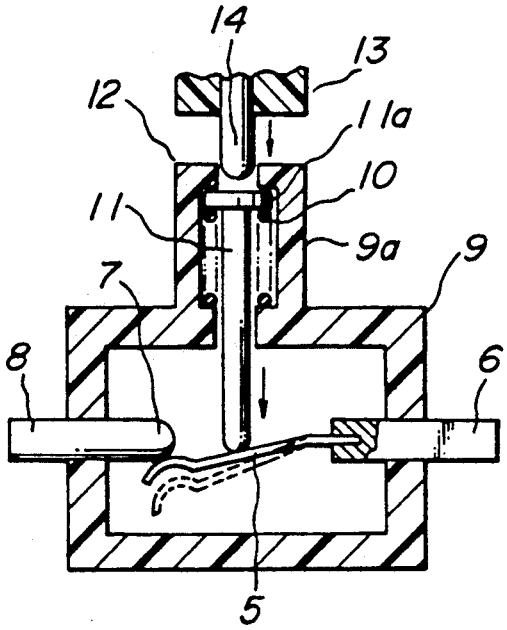
FIG. 9 PRIOR ART
FIG. 9 is a sectional view illustrating a switching unit of the prior art.

In a preferred modification of the invention as shown in FIG. 6, an insulating support member 27 is formed with grooves 27*a* and 27*b* and 27*c* for receiving therein the fixed contact pieces 15 and 16 and the movable contact piece 17. The insulating support member 27 is fitted in the conductive housing 24 to support the fixed contact pieces 15 and 16 in the grooves 27*a* and 27*b* and to guide the movable contact piece 17 in the aperture 27*c*. As shown in FIG. 7, moreover, a terminal may be electrically connected to the forward conductor 17*c* of a movable contact piece 17, for example, by means of a flexible electric wire 28 having dip or slackening instead of connecting to the lower fixed contact piece 16.

As can be seen from the above explanation, the invention provides the improved miniature switching unit which is able to be produced without any difficulties in design and manufacture of the miniature switching unit, and which is high in reliability in operation and exhibits a long service life.

While preferred embodiments have been described, variations thereto will occur to those skilled in the art within the scope of the invention which are delineated by the following claims.

What is claimed is:

1. A miniature switching unit comprising: a housing; fixed contact means disposed within said housing; and movable contact means disposed within said housing; wherein said fixed contact means comprises a first fixed contact piece fixed to a first terminal and a second fixed contact piece fixed to a second terminal, each of said first and second fixed contact pieces being made of springy wire members and including parallel portions having equal inner distances between said parallel portions, wherein said parallel portions of said first fixed contact piece being arranged within said housing a vertical distance above said parallel portions of said second fixed contact piece, and said movable contact means comprises a movable contact piece in the form of a rod having a thickness slightly larger than said inner distances between said parallel portions of the first and second fixed contact pieces, and said movable contact piece including an intermediate insulator having an axial length shorter than said vertical distance between the parallel portions of the first and second fixed contact pieces, an upper conductor axially concentrically and integrally connected to an upper end of the intermediate insulator and a forward conductor axially concentrically and integrally connected to a lower end of the intermediate insulator and having an axial length longer than the vertical distance between the parallel portions of the first and second fixed contact pieces, and said movable contact piece being held in a housing so as to be positioned in and contacting the parallel portions of the first and second fixed contact pieces and movable in a manner such that the intermediate insulator moves across any one of the first and second fixed contact pieces, which are arranged one above the other.

2. The miniature switching unit as set forth in claim 1, wherein each of the first and second contact pieces is U-shaped.

3. The miniature switching unit as set forth in claim 1, wherein each of the first and second contact pieces is loop-shaped.

4. The miniature switching unit as set forth in claim 3, wherein each of the first and second contact pieces is a shape made of two semicircles and two parallel straight lines having equal lengths and connecting the two semicircles.

5. The miniature switching unit as set forth in claim 1, wherein the first and second fixed contact pieces are in parallel with each other and overlapped.

6. The miniature switching unit as set forth in claim 1, wherein said movable contact piece has a circular cross-section.

7. The miniature switching unit as set forth in claim 1, wherein said housing is made of a metal and said first and second terminals are fixed to and electrically insulated from the housing.

8. The miniature switching unit as set forth in claim 1, wherein said unit further comprises an insulating support member disposed within said housing unit, said insulating support member is formed with grooves for receiving and supporting therein said first and second fixed contact pieces and said support member also having a groove for receiving therein said movable contact piece.

* * * * *

UNITED STATES PATENT AND TRADEMARK OFFICE

CERTIFICATE OF CORRECTION

PATENT NO. : 5,264,672
DATED : November 23, 1993
INVENTOR(S) : Masaru Ishii and Susumu Nakagawa It is certified that error appears in the above-indentified patent and that said Letters Patent is hereby corrected as shown below:

Column 3, line 31, after "17b" insert a comma (,);

Column 6, line 40, after "terminal" insert --8--;

Column 6, line 58, change "housing;" to --housing,--;

Column 8, line 21, delete "unit".

Signed and Sealed this

Thirty-first Day of May, 1994

Bruce Lehman

*Attest:*

BRUCE LEHMAN

*Attesting Officer*

*Commissioner of Patents and Trademarks*